United States Patent [19]

Wilhoit

[11] 4,253,527

[45] Mar. 3, 1981

[54] HEAT RESPONSIVE FIRE EXTINGUISHING SYSTEM

[76] Inventor: George D. Wilhoit, 4421 Meade Ave., Fort Myers, Fla. 33901

[21] Appl. No.: 30,516

[22] Filed: Apr. 16, 1979

[51] Int. Cl.[3] ..... A62C 37/12

[52] U.S. Cl. ..... 169/57; 169/42; 169/61

[58] Field of Search ..... 169/11, 16, 19, 42, 169/57, 60, 61; 236/48, DIG. 5

[56] References Cited

U.S. PATENT DOCUMENTS

| | | | |
|---|---|---|---|
| 3,687,329 | 8/1972 | Baum | 169/57 X |
| 3,754,602 | 8/1973 | Magdars | 169/60 |
| 3,810,511 | 5/1974 | James | 169/42 X |

FOREIGN PATENT DOCUMENTS

| | | | |
|---|---|---|---|
| 2390972 | 12/1978 | France | 169/57 |

*Primary Examiner*—Joseph J. Rolla
*Assistant Examiner*—Fred A. Silverberg
*Attorney, Agent, or Firm*—Alfred E. Wilson

[57] ABSTRACT

A heat responsive fire extinguishing system including at least one delivery tube having a plurality of strategically spaced apart openings directed towards the area to be protected, each of the openings being closed by a plug of a suitable material having relatively low temperature fusion points, and wherein a flexible tensioned trigger line operable by the existance of an above normal ambient temperature to open and release a spring tensioned or gravity operated valve to direct a flow of a suitable pressurized fire extinguishing material into the delivery tube and wherein the plugs, exposed to the above normal ambient temperature, will be softened and blown out of the tube holes by the pressure forces of the fire extinguishing material in the tube to discharge fire extinguishing material through the holes to supress or extinguish any surrounding flames.

4 Claims, 6 Drawing Figures

HEAT RESPONSIVE FIRE EXTINGUISHING SYSTEM

BACKGROUND OF THE PRESENT INVENTION

The present invention includes a pressurized fire extinguishing material storage compartment having at least one elongated delivery tube with a plurality of perforations closed by plugs of a suitable fusible material which will be released when subjected to substantially predetermined temperature to release the fire extinguishing material when subjected to the predetermined temperature.

In the past most of the systems of this type utilized water sprays, and as a result the damage caused by the water would in many instances be greater than the damage caused by the fire. Also it will be apparent that in cold climates where the water pipes of the fire extinguishing systems were subjected to freezing conditions the pipes would freeze and burst, then when the ice thawed and melted water would be released in the area it was desired to protect and would cause damage. These difficulties can be overcome by the use of dry fire extinguishing materials in the form of gaseous or powdered materials.

In the present invention a supply of pressurized fire extinguishing material can be provided at a remote location, and a temperature responsive triggering system in the area to be protected can be provided to actuate a valve mechanism to release the fire extinguishing material to a distribution system in the area to be protected.

The distribution system consists of one or more interconnected tubes having suitable apertures along their lengths closed by low temperature melting plugs to release and discharge fire extinguishing material in the area to be protected.

Therefore, one of the principal objects of the present invention is to provide a fire suppression system including at least one elongated perforated delivery tube, and means to sense an unusual rise in temperature in any area along the length of the tube, causing valve means to open to a source of supply of a suitable fire extinguishing material, such as carbon dioxide, whereby the fire extinguishing material will be discharged from the source into the tube, having relatively low fusion point, plugs closing the perforations in the tube, thereby permitting the fire extinguishing material to be discharged in the area of the unusual rise in temperature.

A further object of the instant invention is to provide a heat sensor means in the form of an elongated triggering line provided with a plurality of relatively closely spaced apart loops, extending substantially along the length of each tube, including loop connections formed of a suitable material, such a solder, having a low fusion point.

Yet another object of the present invention is to provide a spring biased switch means connected between a first end of the elongated looped line and a normally closed valve in a conduit connecting between a first end of the perforated tube and the source of supply of the fire extinguishing material, the valve being biased to an open condition when any one of said loops is broken to cause the flow of fire extinguishing material to the delivery tube.

DESCRIPTION OF A PREFERRED FORM OF THE INVENTION

Figure 1:
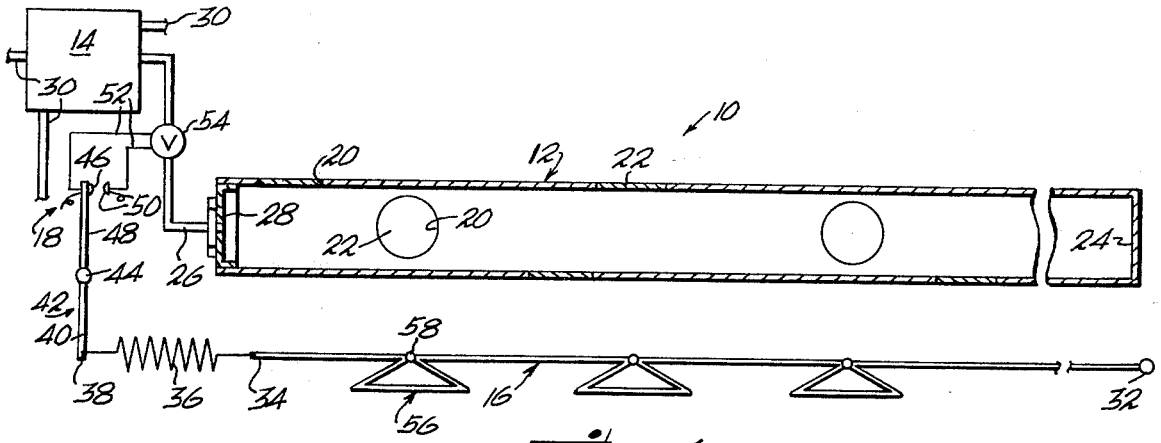
FIG. 1 is a semi-diagrammatic view of the fire suppression system of the present invention.

With reference to the drawings in which like reference characters designate like or corresponding parts throughout the various views, and with particular reference to FIG. 1, the fire suppression system, designated generally at 10, includes at least one elongated delivery tube 2, a source of supply 14 of a suitable fire extinguishing material such as carbon dioxide, for example, a spring biased trigger line 16 and switch means 18, operable by the trigger line 16 to open the source of supply 14 into the delivery tube 12.

With further reference to FIG. 1, the delivery tube 12 includes a plurality of perforations 20, normally closed by plugs 22 formed of a suitable material, such as a thermoplastic material, having an appropriate relatively low fusion point. The size of the perforations 20 and the plugs 22 can be varied as desired in relation to the size of the source of fire extinguishing material supply 14 and the quantity of the fire extinguishing material therein. Delivery tube 12 is closed at 24 at a first end and a conduit 26 from the source of supply 14 connects to a cap 28 at a second end. Additional conduits 30 may be provided to connect with additional delivery tubes such as 12 (not shown).

Trigger line 16 is rigidly anchored at 32 at a first end, and is connected at a second end 34 to a tension spring 36 which connects at 38 to a first arm 40 of a lever 42, centrally pivoted at 44, and yieldingly urged to rotate in a clockwise direction. A movable electric contact 46, fixed to a second lever arm 48, is adapted to close relative to a fixed contact 50 to close a circuit 52 to a valve 54 to open conduit 26 from the source of fire extinguishing material 14 to delivery tube 12. A plurality of loops 56, preferably triangular in form are defined along the length of trigger line 16. Each loop 56 is fixed in a closed position as at 58 by a suitable material having a low fusion point, such as solder, so that exposure to an unusually high temperature will cause the loops 56 to open releasing the tension spring forces of spring 36 which are normally counter to anchor point 32, permitting the contact 46 to engage contact 50 to release the pressurized fire extinguishing material from the source of supply 14 for passage through conduit 26 into the delivery tube 12 to blow out the heat softened plugs 20 to permit its discharge into a fire area.

Figure 4:
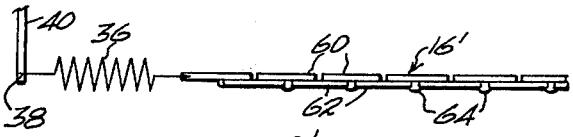
FIG. 4 illustrates a modified form of trigger line.
Figure 3:
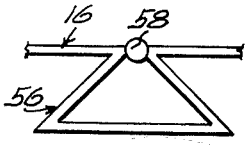
FIG. 3 is an enlarged side elevational view of a preferred loop form of a trigger line incorporated in the present invention.
Figure 2:
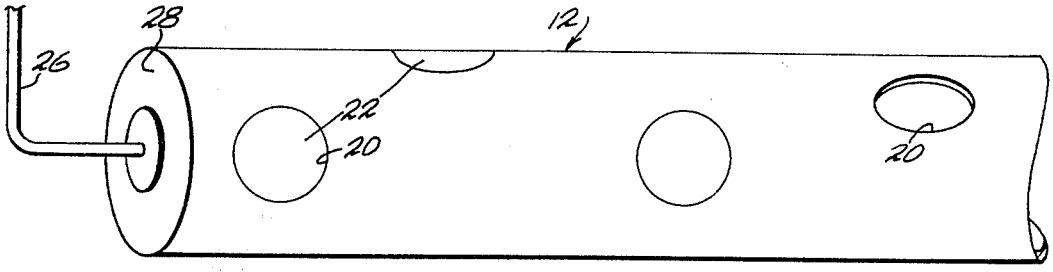
FIG. 2 is a fragmentary perspective view of the fire extinguishing material delivery tube of the present invention.

The trigger line 16', illustrated in FIG. 4 is an alternative form, is lapped along its length as at 60, 62 and is connected as at 64 by a suitable material such as solder.

Figure 5:
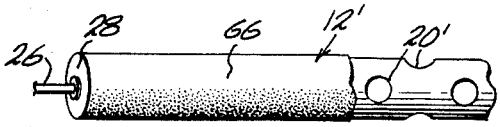
FIG. 5 is a fragmentary perspective view of a modified form of delivery tube.

In the modification of FIG. 5, the delivery tube 12' including the perforations 20' are covered by a sleeve 66 formed of a suitable thermoplastic material having a relatively low melting point.

Figure 6:
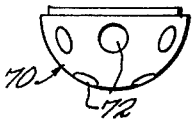
FIG. 6 illustrates a modified form of perforation plug of the present invention.

The plug modification 70 of FIG. 6 is made of a hard material in a generally mushroom configuration and is firmly secured in the perforations 20. A plurality of small holes 72 in plug 70 are normally closed with material having a low fusion point to permit a spray effect in the event of a fire.

In use, the line 16 with loops 56 is juxtaposed in a spaced parallel relation with delivery tube 12 over the area to be fire protected, the length of the system being determined by the area to be serviced. When the temperature of solder 58 reaches a critical level, it fuses and the loops 56 separate at their apexes releasing the compression forces of spring 36. This actuates the fire extinguishing material release mechanism, releasing the pressurized fire extinguishing material such as $CO_2$ from source 14. The pressure forces thereof blows out the softened plugs such as 22 and the fire is covered by the fire extinguishing material $CO_2$ or the like and is smothered, or, at the very least, substantially contained.

There is thus provided by the instant invention, a fire suppression system for use in homes or warehouses, theaters, auditoriums etc or wherever fire suppression is desirable. The pressurized source of fire extinguishing material can be centrally located and the delivery tubes and metal lines laid out and extended by suitable connectors. A further advantage can be achieved by providing a by-pass of a pressurized fire extinguishing material such as $CO_2$ to a fire alarm or a fire house alarm system.

A relatively small capacity for the pressurized extinguishing material is required to protect relatively large areas. High rise buildings, barns, unattended structures as well as cable raceways as used in power plants, particularly nuclear plants, can be protected.

I claim:

1. A fire suppression system comprising, releasably tensioned heat sensor means, a remote pressurized source of any appropriate fire extinguishing material such as carbon dioxide, a heat sensitive delivery means for said fire extinguishing material, means to permit the flow of said pressurized fire extinguishing material from said source to said delivery means, and means interconnected between said tensioned heat sensor means, and means operable in a first position to maintain said fire extinguishing material in said source and responsive to an unusually high ambient temperature about said heat sensor means which releases said tension on said heat sensor means to move said operable means to a second position to permit the flow of said fire extinguishing material from said source through said means to permit the flow of fire extinguishing material to said delivery means, wherein said heat sensor means comprises a generally linearly oriented flexible metal line including expansion means and having a first end anchored in a spaced relation to a first end of said delivery means, and a second end adjacent to a second end of said delivery means and having a tension spring connection to maintain a normally open switch condition, said interconnected means operably connected to said means to permit said flow in a manner so as to maintain said fire extinguishing material in said source during said normally open switch condition and to move to a switch closed position to open said means to permit the flow from said source to said delivery means in response to a reaction of said high ambient temperature on said expansion means, wherein said linearly oriented line is interrupted along its length by a plurality of spaced apart loops, said loops comprising said expansion means, formed in said line, and including fixed loop closures formed by a suitable metal having a relatively low fusion point, such as solder, whereby fusion of any one or more of said loop closures will result in an extension of said line under the forces of said tension spring thereby releasing the tension forces therein to move said switch to said closed position.

2. The fire suppression system as defined in claim 1 wherein each of said loops is generally triangular in form, said closure being formed at an apex of each loop.

3. The fire suppression system as defined in claim 1 wherein said fire extinguishing material delivery means comprises at least one elongated hollow cylindrical tube closed at said first end and connected at said second end to said means to permit the flow of fire extinguishing material, a main cylindrical wall of said tube including a plurality of randomly spaced apart perforations along its length, each of said openings being normally closed by a plug formed of any suitable heat reactive material, such as a suitable thermoplastic, to soften under the influence of a relatively high ambient temperature to be blown out under the influence of predetermined pressure forces within said tube.

4. The fire suppression system as defined in claim 3 wherein said perforations are clustered in a close association to provide a spray effect.

* * * * *